United States Patent [19]

Hannson

[11] 3,957,248

[45] *May 18, 1976

[54] AIR HOIST WITH AN OVERLOAD PROTECTION DEVICE

[75] Inventor: Gunnar Christer Hannson, Stockholm, Sweden

[73] Assignee: Atlas Copco Aktiebolag, Nacka, Sweden

[ * ] Notice: The portion of the term of this patent subsequent to Apr. 8, 1992, has been disclaimed.

[22] Filed: Sept. 16, 1974

[21] Appl. No.: 506,608

Related U.S. Application Data

[63] Continuation of Ser. No. 336,385, Feb. 27, 1973, Pat. No. 3,876,182.

[30] Foreign Application Priority Data

Mar. 6, 1972 Sweden ..... 2816/72

[52] U.S. Cl. ..... 254/168; 254/187 D

[51] Int. Cl.[2] ..... B66D 1/00

[58] Field of Search ..... 254/168, 167, 174, 172, 254/169, 187 D, 186 R; 192/3; 188/170, 134

[56] References Cited

UNITED STATES PATENTS

| | | | |
|---|---|---|---|
| 3,384,350 | 5/1968 | Powell | 254/168 |
| 3,669,411 | 6/1972 | McKendrick | 254/168 |

*Primary Examiner*—Robert J. Spar
*Assistant Examiner*—Kenneth Noland
*Attorney, Agent, or Firm*—Flynn & Frishauf

[57] ABSTRACT

The pneumatic motor of an air hoist has a blow-off valve in its supply passage. When the blow-off valve is open to the atmosphere, the air pressure at the inlet of the motor is substantially reduced. The blow-off valve is held closed by a piston having a piston surface in an air chamber. The air chamber is supplied with compressed air through a restriction. The hoist has a hook by which it can be suspended and the hook is clamped to the housing of the hoist by means of a pre-loaded Belleville-spring. When the spring yields due to overload, a vent valve will open and vent said air chamber. As a result, the blow-off valve suddenly opens to limit the torque of the motor.

24 Claims, 5 Drawing Figures

AIR HOIST WITH AN OVERLOAD PROTECTION DEVICE

This is a continuation of application Ser. No. 336,385, filed Feb. 27, 1973 now U.S. Pat. No. 3,876,182.

This invention relates to an air hoist which has an air motor and is provided with an overload protection device with a load sensing device.

In a prior art air hoist of this kind, the load sensing device includes a venting valve which vents a control conduit of a shut-off valve in the supply conduit of the motor when the load reaches a pre-determined magnitude so that the shut-off valve closes. In order to prevent the shut-off valve from closing at normal handling of a permissible workload, the load sensing device must normally be set to open the venting valve at a load of 140% of the weight of the heaviest workload permissible (i.e., rated workload) since the additional dynamic forces can be up to 40% of the workload. This means that it is possible to lift a workload which is considerably larger, in this case 40% larger, than the heaviest workload permissible (i.e., rated workload) if the workload is carefully handled.

It is an object of the present invention to provide an air hoist with an overload protection device which prevents the lifting of workloads only slightly heavier than the heaviest workload permissible without negatively affecting the handling of a permissible workload. From another point of view, it is an object to provide an air hoist which ensures a gentle start even when unskilfully operated.

Figure 1:
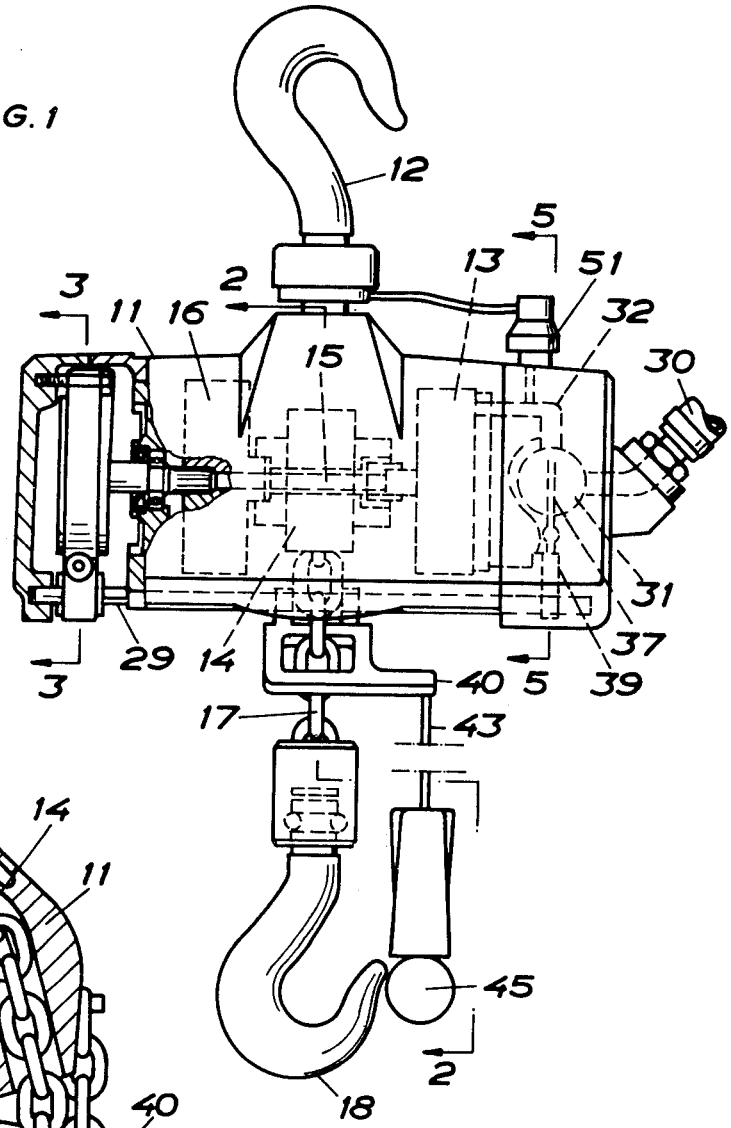
Figure 2:
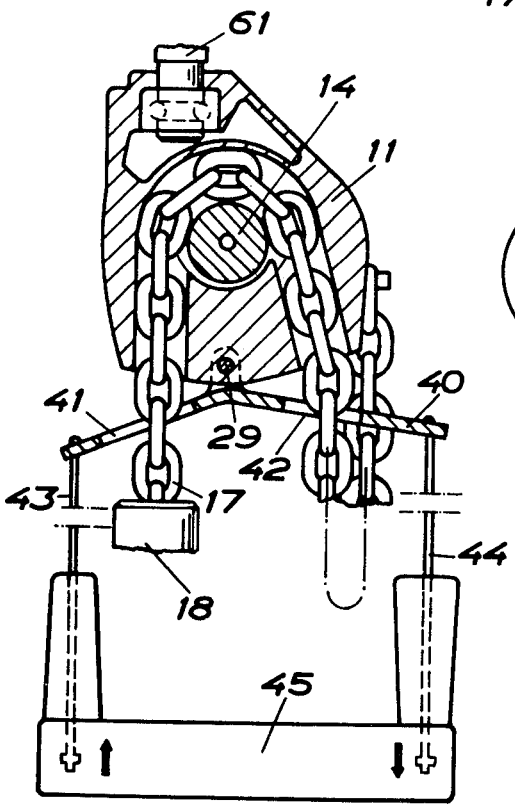
Figure 3:
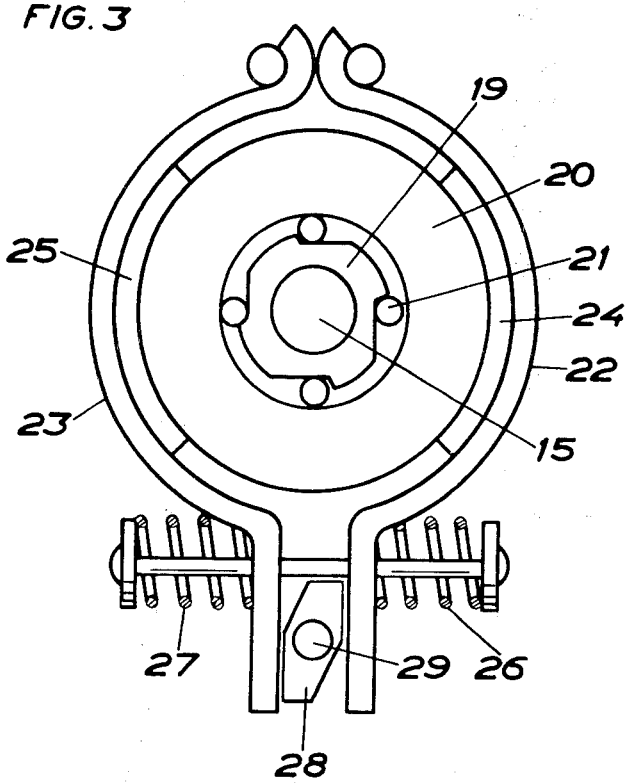
Figure 5:
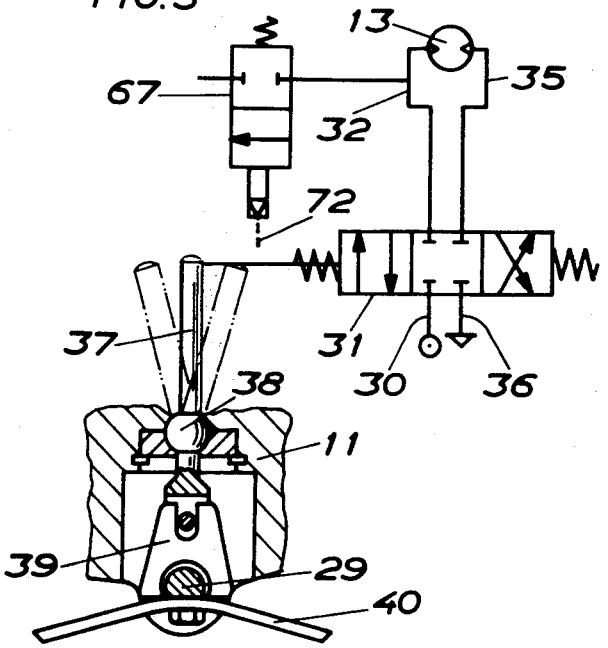
Figure 4:
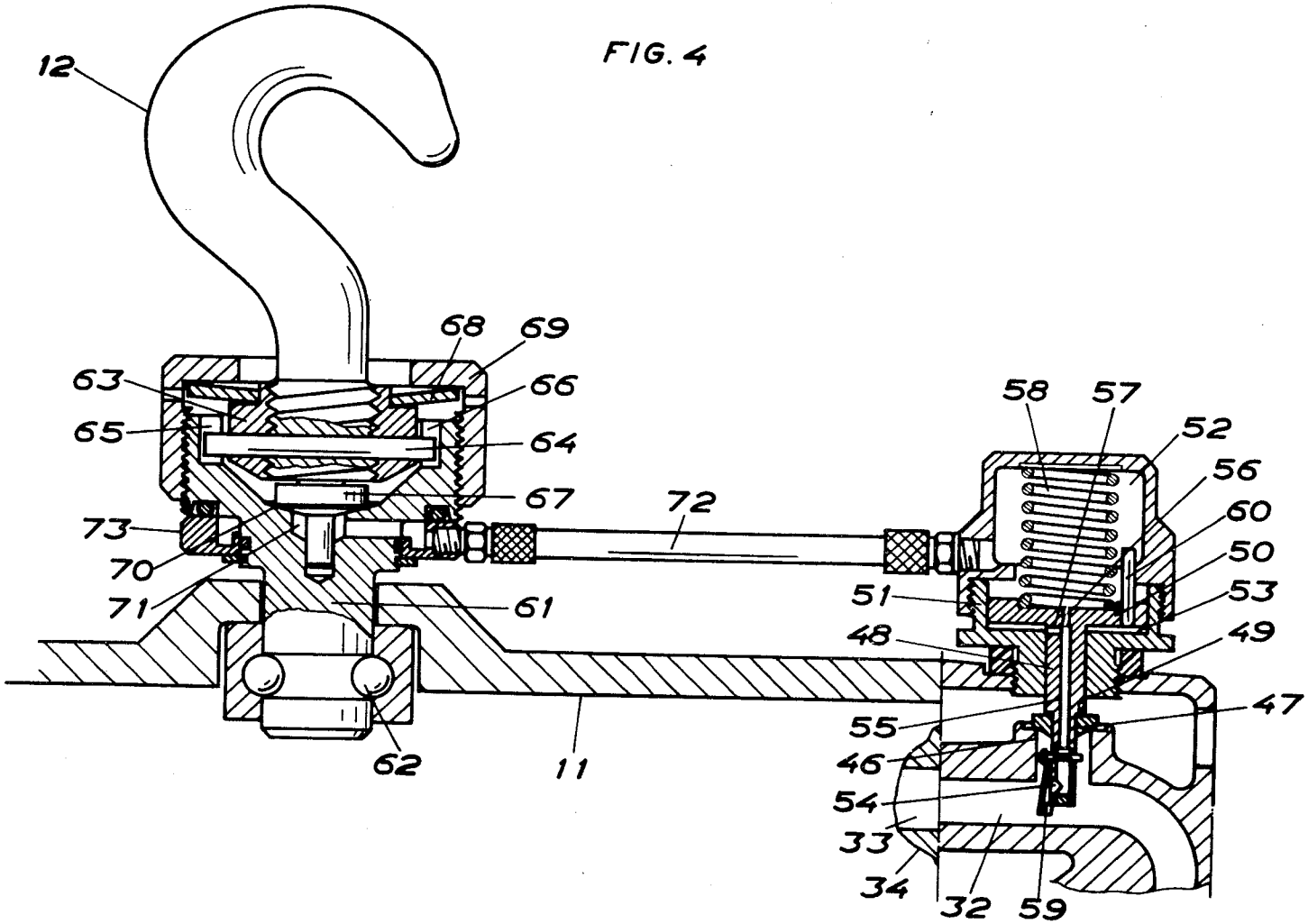

The invention will be further described with reference to the accompanying drawings in which FIG. 1 is an elevational view of an air hoist according to the invention, FIG. 2 is a cross-section taken along line 2—2 in FIG. 1, FIG. 3 is a cross-section taken along line 3—3 in FIG. 1, FIG. 4 is an enlarged fragmentary detail section of a part of FIG. 1 and FIG. 5 illustrates circuitry for the air hoist shown in FIGS. 1–4 and it is also partly a section taken along line 5—5 in FIG. 1.

The air hoist shown in the FIGS. has a housing 11 and a suspender hook 12 by which it can be suspended for example in a trolley. A reversible air motor 13 rotates a drum or wheel drive 14 (chain pulley) over a transmission that comprises a central shaft 15 and a conventional planet gear unit 16 driven by this shaft. The drum or wheel drive 14 carries a chain 17 which has a hook 18 for the workload at its free end.

A conventional one-way clutch (FIG. 3) is mounted on the end of the central shaft 15 and it comprises an inner part 19 rotating with the central shaft 15, an outer drum 20, and four rollers 21 which are disposed in recesses in the inner part 19. The drum 20 of the one-way clutch can be locked to the housing 11 of the air hoist by means of two brake shoes 22,23 with linings 24,25. The brake shoes 22,23 are biased engaged by springs 26,27, but they can be relieved by means of a cam 28 which is fastened on a control shaft 29 journalled in the housing 11.

The motor 13 — for instance a sliding vane motor or a radial piston motor — is supplied with pressurized air from a hose 30 through an air distributing valve 31 in the form of a slide and a supply passage 32. The supply passage 32 is connected to an inlet 33 in the cylinder 34 of the motor. The motor has also an alternative supply passage 35 as can be seen from FIG. 5 in which the air distributing valve 31 is schematically shown. In its neutral position, shown in this figure, the air distributing valve 31 shuts off the two supply passages 32,35.

In the air distributing valve 31 is moved to the right in FIG. 5, the passage 32 will be pressurized and the passage 35 connected to an exhaust 36. The motor will therefore rotate in the load-lifting direction. If the air distributing valve 31 is moved to the left, the motor will rotate in the load lowering direction since the passage 35 is now pressurized and the passage 32 is connected to the exhaust 36.

The air distributing valve 31 is controlled by means of a lever 37 which is pivotably mounted in the housing 11 by means of a ball joint 38 and actuated by means of a cam 39 which is fastened to a control shaft 29.

A yoke 40 is fastened on the control shaft 29 and is provided with openings 41,42 through which the chain 17 can freely run. Two control ropes 43,44 are suspended at the ends of the yoke 40 and they carry a control handle 45. When the control rope is pulled by means of the handle 45, the control shaft 29 and its cams 28,39 turn counter-clockwise (FIGS. 2, 3 and 5). The counter-clockwise turning of the cam 39 results in a clockwise turning of the lever 37 so that the air distributing valve 31 moves to its right position, and the motor starts rotating in the load-raising direction. The counter-clockwise turning of the cam 28 does not release the brake shoes 22,23 since the cam is unsymmetrical. However, the one-way clutch 19,20,21 will permit the motor 13 to rotate in this direction. If the workload carrying hook 18 is run too high, it abuts the yoke 40 around the opening 41 and turns the yoke back so that the air distributing valve 31 is moved to its neutral position or to its position for lowering the load.

When the control rope 44 is pulled by means of the handle 45, the control shaft 29 turns clockwise. The cam 39 of the control shaft pulls via the lever 37 the air distributing valve 31 into its left position so that the motor 13 starts rotating in load-lowering direction and the cam 28 lifts the brake shoes 22,23 so that the one-way clutch 19,20,21 can rotate as a unit and therefore does not prevent this rotation.

Referring to FIG. 4, in the supply passage 32 there is an exhaust opening 46 into an air cushion chamber. The opening 46 forms a seat for a valving member 47 which is disposed on a rod 48 and abuts a shoulder 49 on the rod 48. The valving member 47 and its seat 46 form a blow-off valve. The rod 48 is a piston rod of a piston 50 which divides a cylinder 51 into two pressure chambers 52, 53 which are connected to the supply passage 32 through an opening 54 in the cylindrical face of the piston rod, an axial passage 55 in the piston rod, and two short and restricted branches 56,57 of this axial passage 55. A spring 58 biases the piston 50 downward in FIG. 4 and keeps thereby the blow-off valve 46,47 normally closed. A flap 59 projects out into the supply passage 32 so that it will be influenced by the air stream in this supply passage to shut off the opening 54 when there is a strong air stream from the motor 13. The flap 59 is normally in the open position as shown in FIG. 4 and a guide pin 60 prevents rotation of the piston 50 and piston rod 48.

A mount 61 for the suspender hook 12 is turnably mounted in the housing 11 of the air hoist by means of balls 62. A nut 63 is screwed onto the hook 12 and locked by means of a pin 64 which prevents the nut 63 from turning relative to the mount 61 but permits axial movement between the nut and the mount since its ends project out into axial grooves 65,66 in the mount.

The hook 12 is pressed against a valving member 67 by means of a Belleville-spring 68 which is clamped between the nut 63 and an outer nut 69. The valving member 67 is thereby pressed against a valve seat 70 so as to seal off a valve chamber 71. By means of the nut 69, the pre-load of the Belleville-spring 68 can be adjusted very precisely. The valve chamber 71 is connected by means of a swivel 73 and a hose 72 to the upper pressure chamber 52 and when the load exceeds the pre-load of the Belleville-spring 68, the air hoist moves distinctly some tenths of a millimeter so that the venting valve 67,70 vents the pressure chamber 52. As a result, the piston 50 moves upwards and the blow-off valve 46,47 opens.

If the operator rapidly opens the distributing valve 31 in order to lift a heavy but permissible work load (i.e., a load equal to or less than the rated load), the instantaneous pulling force can exceed the pre-load of the Belleville-spring 68 so that the venting valve 67,70 opens to initiate the opening of the blow-off valve 46,47 as previously described. Because of the blow-off from the supply passage 32 of the motor, the pressure of the drive air will reduce to a pressure which is determined by the combination of the size of the blow-off valve 46,47 the restriction function of the air distributing valve 31, and the line pressure. This predetermined reduced drive pressure can for instance be just enough to lift the heaviest workload permissible but it can also be permitted to be insufficient to lift this load since the one-way clutch will prevent any workload fom pulling the motor rearwards. If the workload that the operator is about to lift, is lower than the pre-load of the Belleville-spring, the spring will close the venting valve 67,70 again. As a result, the pressure chamber 52 will slowly be pressurized so that the blow-off valve 46,47 slowly closes. The drive pressure will therefore slowly raise so that the start will be gentle.

Due to the faster pressure build-up in the lower pressure chamber 53 than in the upper pressure chamber 52 when the supply passage 32 is suddenly pressurized, the blow-off valve 46,47 will always open and then it will close as the pressure difference of the pressure chambers 52,53 reduces so that the drive air pressure will slowly increase. This ensures a gentle start also for a workload for which the venting valve 67,70 does not open. In FIG. 4, the restrictions 56,57 have the same area, but the large volume of the upper pressure chamber 52 of which the volumes of the hose 72 and the valve chamber 71 are part makes the pressure build-up in this pressure chamber 52 slower than in the pressure chamber 53. Of course this volume can be reduced if the restriction 56 is narrower than the restriction 57.

During lowering of a workload, the passage 32 serves as an exhaust passage from the motor as previously described and the flap 59 keeps the opening 54 closed. If the venting valve 67,70 would open during the lowering of a workload, it can happen that the blow-off valve 46,47 opens. However, because of air streaming from the lower pressure chamber 53 through the restrictions 56,57 and into the upper pressure chamber 52, the pressure in the pressure chambers 52,53 will soon equalize, and the coil spring 58 closes the blow-off valve 46,47 again so that the counter pressure in the exhaust passage 32 of the motor is maintained.

Because of the pressure working directly upon the valving member 47, the blow-off valve 46,47 will rapidly open like a conventional relief valve when there is an extreme pressure raise in the supply passage 32. If the workload is heavy and the chain slack at the start or the air distributing valve is rapidly closed when a heavy workload is lowered, there can be such an extreme pressure raise.

The one-way clutch 19,20,21 is not necessary but the brake drum 20 can be affixed on the central shaft 15. In this case, the cam 28 for the brake shoes 22,23 must be symmetrical so that it releases the brake shoes not only when the air distributing valve 31 is turned to its position for lowering a workload but also when it is turned to its position for raising a workload. Furthermore, for the reason of safety, the reduced drive pressure during open blow-off valve 46,47 must be great enough not to permit a workload as heavy as the pre-load of the Belleville-spring 68 to pull the motor rearwards.

The sensing of the load need of course not be associated with a suspender hook. For instance, in case the chain or cable is reeved around a pulley carrying a hook for the load, the load sensing device can be associated with the end of the chain or cable which is affixed to the housing of the air hoist. In the expression "air hoist" there is included not only air hoists adapted to be suspended but also air hoists adapted for pulling horizontally and not only for lifting.

What I claim is:

1. An air hoist comprising:

a rotatable drive wheel carrying a line which in turn is adapted to carry a work load, an air motor for rotating said drive wheel to retrieve said line, a supply conduit connected to an inlet of the motor for supplying motive air to the motor, a normally closed blow-off valve connected to said supply conduit so as to effect, when in an open position, a reduction of the motive air pressure at the inlet of said motor due to an increased pressure loss in said supply conduit and substantially located upstream of the blow-off valve, whereby to limit the power of the motor, and a load sensing device arranged to initiate the opening of the blow-off valve in response to the tension in the line reaching a predetermined magnitude.

2. An air hoist as claimed in claim 1 in which said blow-off valve is controlled by a piston which is loaded by the air pressure in a pressure chamber towards a position in which the blow-off valve is closed, said air chamber being supplied with compressed air through a restricted passage, and the load sensing device comprises a vent valve connected to said pressure chamber for selectively venting this chamber and thereby initiating the opening of the blow-off valve.

3. An air hoist as claimed in claim 2 in which said load sensing device comprises two force-transmitting members which are resiliently clamped together so as to form said venting valve.

4. An air hoist as claimed in claim 3 in which said two members are clamped together by means of a preloaded Belleville-spring.

5. An air hoist as claimed in claim 3 in which one of said two members forming the venting valve is a mount for a suspender for the air hoist, a member associated with the suspender being the other of the two members forming the venting valve.

6. An air hoist as claimed in claim 1 in which: means is provided for controlling said blow-off valve, said control means including piston means loaded by the pressure in a first pressure chamber towards a position in which the blow-off valve is closed and loaded by the pressure in a second pressure chamber towards a position in which the blow-off valve is open, said first and second pressure chambers being adapted to be supplied with compressed air through restricted passages and the blow-off valve being biased closed; and said load sensing device comprises a vent valve connected to said first pressure chamber for selectively venting said first pressure chamber and thereby initiating the opening of the blow-off valve.

7. An air hoist as claimed in claim 6 in which the blow-off valve is biased closed by means of a spring.

8. An air hoist as claimed in claim 7 in which the blow-off valve is indirectly loaded by the spring through the piston means.

9. An air hoist as claimed in claim 6 in which said restricted passages lead from the supply conduit and are so sized relative to the volumes of said first and second pressure chambers that the pressure will build up more rapidly in said second pressure chamber than in said first pressure chamber and thereby effect opening of the blow-off valve when the supply conduit is suddenly pressurized.

10. An air hoist as claimed in claim 9 in which said piston means has a first area working in the first pressure chamber and a second area working in the second pressure chamber, said first area being larger than said second area.

11. An air hoist as claimed in claim 9 in which a valve seat and a valving member form said blow-off valve, said valving member being disposed on a piston rod of said piston means.

12. An air hoist as claimed in claim 11 in which said restricted passages are passages in said piston rod.

13. An air hoist as claimed in claim 9 in which said supply conduit is connected to an air distributing valve which has a position for lowering a work load in which position it connects said supply conduit to be an exhaust passage and pressurizes an alternative supply conduit, and a check valve is controlled by the stream of air in said first mentioned supply conduit so as to shut off said first and second restricted passages when there is an air stream from the motor.

14. An air hoist as claimed in claim 13 in which said restricted passages have a common inlet opening in the surface of the piston rod and said check valve is a flap mounted on the piston rod and protruding into the supply conduit so as to be pressed against the piston rod to shut off said inlet opening when air streams from the motor.

15. An air hoist as claimed in claim 13 in which a releasable brake is operably connected between a shaft rotated by the motor and a housing of the hoist, and a one-way clutch is operably connected between said shaft and said brake so as to permit the motor to rotate in the direction of pulling also when the brake is engaged.

16. An air hoist as claimed in claim 15 in which said brake is adapted to be released when the supply passage for effecting pulling is pressurized.

17. An air hoist as claimed in claim 16 in which said brake and said air distributing valve are operated by means of a common actuating device.

18. An air hoist as claimed in claim 1 including an air distributing valve, the blow-off valve being connected to the supply conduit at a point between the motor and the air distributing valve.

19. An air hoist as claimed in claim 1 including an air distributing valve, the blow-off valve being connected to the supply conduit at a point between the motor and the air distributing valve so that a substantial part of said pressure loss occurs in said air distributing valve.

20. An air hoist as defined in claim 1 further comprising means responsive to load lowering rotation of said drive wheel to inhibit opening of said blow-off valve.

21. An air hoist comprising:

a housing, a suspension device by which the air hoist can be suspended, said suspension device being mounted to the housing, a rotatable drive wheel carrying a line for hoisting a workload, a rotary air motor for rotating said drive wheel to retrieve said line, a supply conduit connected to an inlet of the motor for supplying motive air to the motor;

a normally closed blow-off valve connected to said supply conduit so as to effect, when in an open position, a reduction of the motive air pressure at said inlet of the motor due to an increased pressure loss in the supply conduit and substantially located upstream of the blow-off valve, and a pilot valve within said suspension device sensing the force transmitted through said suspension device and connected to initiate said blow-off valve to open when said sensed force reaches a predetermined magnitude.

22. An air hoist as defined in claim 21 further comprising means responsive to reverse running of said motor to inhibit opening of said blow-off valve.

23. An air hoist comprising:

a rotatable drive wheel carrying a line which in turn is adapted to carry a work load, an air motor for rotating said drive wheel to retrieve said line, a supply conduit connected to an inlet of the motor and including a supply valve, a normally closed blow-off valve connected to the supply conduit between the supply valve and the inlet of the motor and adapted to open when the supply conduit is suddenly pressurized, whereby to reduce the motive air pressure at the motor inlet due to an increased pressure loss in the supply conduit and substantially located upstream of the blow-off valve, and means to provide for a slow closing of said blow-off valve to ensure a gentle start of said motor due to a slow pressure build-up at the motor inlet.

24. An air hoist as claimed in claim 23 in which: said blow-off valve is controlled by a piston means which is loaded by the pressure in a first pressure chamber towards a position in which the blow-off valve is closed and loaded by the pressure in a second pressure chamber towards a position in which the blow-off valve is open; a first restricted passage leads from said supply conduit to said first pressure chamber; a second restricted passage leads from said supply conduit to said second pressure chamber; and said first and second restricted passages are so sized relative to the volumes of said first and second pressure chambers that the pressure will build up more rapidly in said second pressure chamber than in said first pressure chamber and thereby effect opening of the blow-off valve when the supply conduit is suddenly pressurized.

* * * * *

UNITED STATES PATENT AND TRADEMARK OFFICE

CERTIFICATE OF CORRECTION

PATENT NO. : 3,957,248

DATED : May 18, 1976

INVENTOR(S) : Gunnar Christer Hansson

It is certified that error appears in the above-identified patent and that said Letters Patent are hereby corrected as shown below:

In the heading of the patent, change inventor's last name from "Hannson" to --Hansson--.

Signed and Sealed this

Twentieth Day of July 1976

[SEAL]

*Attest:*

RUTH C. MASON
*Attesting Officer*

C. MARSHALL DANN
*Commissioner of Patents and Trademarks*